United States Patent [19]

Bedford

[11] Patent Number: 5,020,670

[45] Date of Patent: Jun. 4, 1991

[54] SHIPPING CARTON AND DIPSENSER FOR SPONGE ARTICLES

[75] Inventor: Peter H. Bedford, 3817 Mistral Ave., Huntington Beach, Calif. 92649

[73] Assignee: Peter H. Bedford, Huntington Beach, Calif.

[21] Appl. No.: 565,942

[22] Filed: Aug. 10, 1990

[51] Int. Cl.[5] ..... B65D 21/00

[52] U.S. Cl. ..... 206/499; 206/634; 229/11; 229/20; 229/122; 229/101; 221/305

[58] Field of Search ..... 206/499, 607, 627, 634; 229/11, 20, 122, 122.1, 101; 221/305

[56] References Cited

U.S. PATENT DOCUMENTS

| | | | |
|---|---|---|---|
| 1,823,572 | 9/1931 | Reed | 229/20 |
| 2,577,862 | 12/1951 | Shaw, Jr. | 229/11 |
| 3,160,342 | 12/1964 | Murdock et al. | 229/11 |
| 3,568,883 | 3/1971 | Reynolds | 221/305 |
| 4,148,413 | 4/1979 | Immordino | 221/305 |
| 4,497,432 | 2/1985 | Milia | 229/122 |
| 4,767,022 | 8/1988 | Oldorf | 229/122 |
| 4,801,045 | 1/1989 | Barnhart | 229/122 |
| 4,866,806 | 9/1989 | Bedford | 15/104.94 |

FOREIGN PATENT DOCUMENTS

| | | | |
|---|---|---|---|
| 1422197 | 11/1965 | France | 229/122.1 |
| 2458480 | 2/1981 | France | 229/122.1 |

*Primary Examiner*—David T. Fidei

[57] ABSTRACT

A shipping container for sponge articles converts into a dispensing container for the articles by simply unfastening a hinged bottom on the container. The shipping container holds many more sponge articles than its size would apparently allow by holding the sponge articles in a compressed state.

6 Claims, 1 Drawing Sheet

SHIPPING CARTON AND DIPSENSER FOR SPONGE ARTICLES

BACKGROUND OF THE INVENTION

1. Field of the Invention

The present invention relates generally to improvements in containers and more particularly, pertains to new and improved packages which function as both a shipping carton and dispensing container.

2. Description of the Prior Art

In the field of packaging for shipment of individually packaged sponge articles, like surgical scrub sponges, for example, it has been the practice to employ standard boxes or cartons within which the sponge articles are packed in an uncompressed state. The use of such packaging for shipping has been unsatisfactory in that large boxes are required to contain a large number of articles. Such cartons have also been unsatisfactory in dispensing the articles in that these large boxes cannot be conveniently located in areas where these surgical scrub sponges, for example, are to be utilized. The result is that individual surgical sponges are stacked in the area of general use without any containment whatsoever.

It is an object of this invention to provide a shipping container for sponge articles that contains a relatively large number of sponge articles within a reasonably sized container which can also function as a convenient dispenser of such articles at the point of use when opened.

SUMMARY OF THE INVENTION

According to the present invention the foregoing and other objects are obtained by a container-dispenser that comprises two container halves of about equal size, one half fitting over the other as a top over a bottom, but completely covering the sides and top of the bottom half. The top container has a hinged end flap that closes over the bottom of the bottom container. The bottom container has a dispensing opening at its base which is sized for the articles inside. This opening is covered by the top container until the hinged flap is released. The sponges are packed inside both containers and then compressed to fit within the bottom container.

BRIEF DESCRIPTION OF THE DRAWINGS

The exact nature of this invention, as well as other objects and advantages thereof will be readily apparent upon consideration of the following specification as related to the accompanying drawings in which like reference numerals designate like parts throughout the figures thereof and wherein.

DESCRIPTION OF THE PREFERRED EMBODIMENTS

Figure 1:
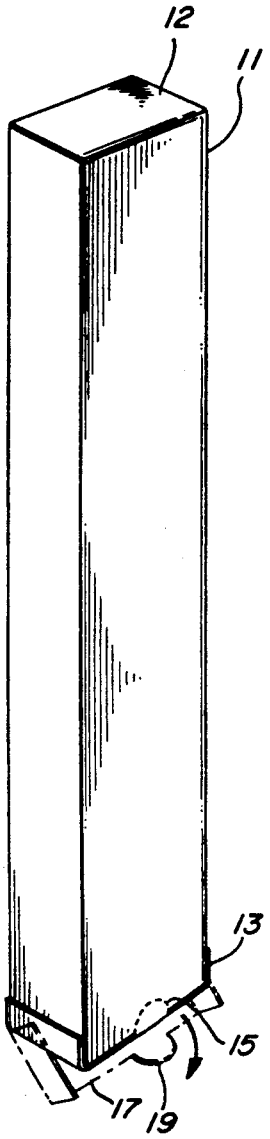
FIG. 1 is a three-dimensional perspective showing the shipping carton and dispenser according to the present invention.

FIG. 1 illustrates a preferred embodiment of the shipping carton dispenser according to the present invention shown in its shipping carton mode. The container 11 is elongated having length and width dimensions that accommodate the sponge articles contained within. The height of the carton 11 is chosen for convenience for locating at the user's site, such as a wash-up sink, for example. Preferably the carton height should be between 1½ to 2 feet. The top 12 of the container 11 is sealed. The bottom 13 of container 11 has a hinged flap bottom 17 which can opened and close the bottom end. A tab 19 which can be disengaged from attachment area 15 on the bottom 13 of container 11, is shown in phantom as attached to the hinged flap 17.

Figure 2:
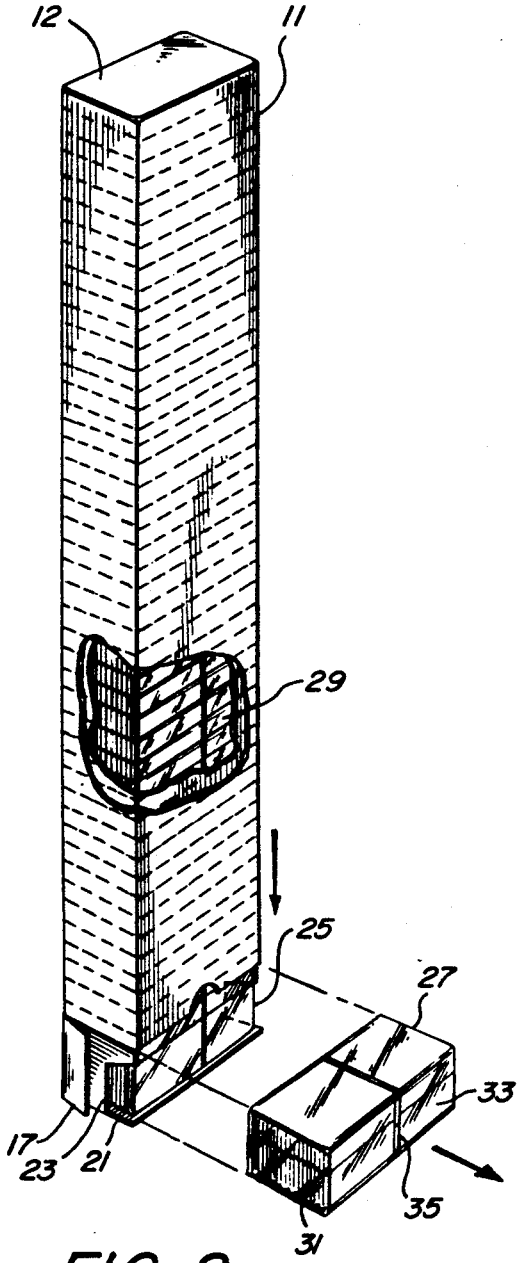
FIG. 2 is a partially cut away perspective and partial blow-up showing the shipping carton and dispenser according to the present invention and its contents while in dispenser mode.

Turning now to FIG. 2, a more detailed view of container 11 is illustrated as including a bottom container 21 that fits within the dimensions of top container 11. With the bottom flap 17 of top container 11 detached, as shown in FIG. 2, the bottom container 21 exposes its slot 23 in one of its side walls. This slot is sized to allow a sponge article 25 at the bottom of bottom container 21 to be extracted. As can be seen from the break-away section of FIG. 2, a plurality of sponge articles 29 are tightly stacked within the bottom container 21. These sponge articles 29 tend to expand slightly when the bottom flap 17 of top container 11 is broken free, pushing top container 11 up to expose slot 23.

The sponge article 27 that may be contained within and then extracted from the container 11 may be the type of surgical scrub sponge that is fully described in the U.S. Pat. No. 4,866,806 patented on Sept. 19, 1989 by Peter H. Bedford, the same inventor as the applicant herein. To the extent that the disclosure of U.S. Pat. No. 4,866,806 is required for a full understanding of the present invention, that disclosure is incorporated herein by reference.

Sponge article 27 is essentially an individual sponge 31 which may be of the type illustrated and described in U.S. Pat. No. 4,866,806, or an equivalent thereof, contained in a sealed wrapper 33 which has a convenient tear strip 35 built therein for easy opening. The dispenser container (FIG. 2) may be attached to a wall by any convenient method such as double-sided tape (not shown) for example. Once the bottom flap 17 has been opened to allow removal of the sponge articles 25 within, the container turns into a convenient dispensing receptacle for the sponge articles.

Figure 3:
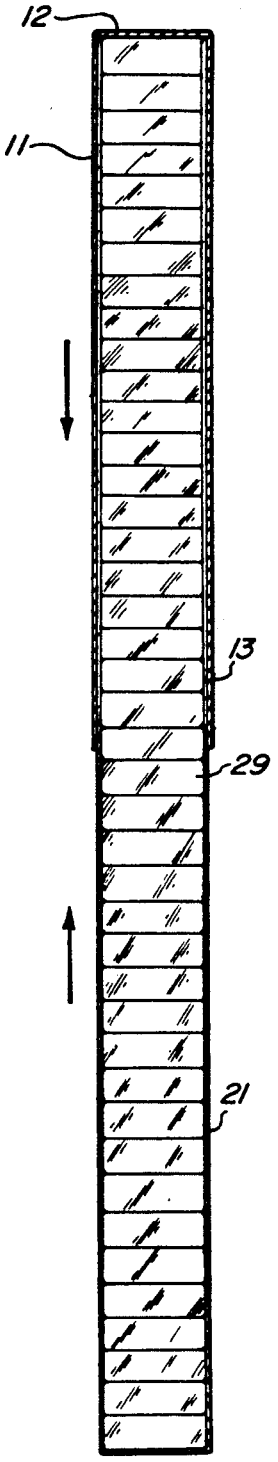
FIG. 3 is a side elevation showing the shipping carton and dispenser of the present invention being loaded with the sponge articles prior to sealing of the package into a shipping carton.

As illustrated in FIG. 3, the container of the present invention holds a much larger number of individual sponge articles 29 than one would assume from the size of the container itself. The sponge articles 29 are compressed between the top container 11 and the bottom container 21 to at least half of their original height or more. Considerably more force is exerted on the container as a result. The container must be constructed to withstand these forces. According to the present invention, a top 11 and a bottom 21 which slides within the top 11 causes the packaging carton when assembled for shipping to have double wall construction. This construction resists any bursting forces that would be exerted by the sponge articles.

What has been described is a container for sponge articles that is structured to hold a large number of sponge articles in a compressed state. Upon being opened, the carton converts to a convenient dispenser for dispensing these articles one at a time in an orderly manner.

Having thus described the invention, what is claimed is:

1. A combined shipping and dispenser container for sponge articles of a size capable of being held in a human hand, said container comprising:

a bottom container having length and width dimensions sized to the length and width dimensions of the sponge articles to be contained therein, said bottom container having an open top and a closed bottom, with a slot, through which one sponge article can fit, cut into one side at its closed bottom;

a top container sized slightly larger in length, width and height than said bottom container so as to slidably fit over said bottom container, said top container having a closed top and a hinged bottom flap that fits over the bottom of said bottom container when assembled for shipping; and a plurality of sponge articles stacked one on top of the other in said bottom container and compressed when the top container is sealed to said bottom container.

2. The combined shipping and dispensing container of claim 1 wherein said bottom flap attaches to seal the top container to said bottom container into a closed shipping configuration.

3. The combined shipping and dispensing container of claim 2 wherein said bottom flap is easily detached allowing said top container to slip upwards to expose the dispensing slot in said bottom container.

4. The combined shipping and dispensing container of claim 3 wherein the sponge articles contained therein are compressed to at least half their height when the top container is sealed to said bottom container.

5. The combined shipping and dispensing container of claim 1 wherein each sponge article is individually wrapped and sealed.

6. The combined shipping and dispensing container of claim 1 wherein said sponge articles partially expand when said bottom flap of said top container is detached pushing said top container upwards to expose said dispensing slot for the sponge articles inside.

* * * * *